US007207643B2

(12) United States Patent
Ioka et al.

(10) Patent No.: US 7,207,643 B2
(45) Date of Patent: Apr. 24, 2007

(54) IMAGE FORMING APPARATUS

(75) Inventors: Ken Ioka, Hachioji (JP); Yasuhiro Komiya, Hino (JP)

(73) Assignee: Olympus Optical Co., Ltd., Tokyo (JP)

( * ) Notice: Subject to any disclaimer, the term of this patent is extended or adjusted under 35 U.S.C. 154(b) by 325 days.

(21) Appl. No.: 10/634,381

(22) Filed: Aug. 4, 2003

(65) Prior Publication Data

US 2004/0041863 A1 Mar. 4, 2004

Related U.S. Application Data

(63) Continuation of application No. PCT/JP02/00890, filed on Feb. 4, 2002.

(30) Foreign Application Priority Data

Feb. 6, 2001 (JP) ..... 2001-029835

(51) Int. Cl.
*B41J 29/393* (2006.01)

(52) U.S. Cl. ..... 347/19; 347/12

(58) Field of Classification Search ..... 347/19, 347/12

See application file for complete search history.

(56) References Cited

U.S. PATENT DOCUMENTS 5,898,443 A * 4/1999 Yoshino et al. ..... 347/19
6,332,665 B1 * 12/2001 Mantell et al. ..... 347/37
6,386,668 B1 5/2002 Shimizu et al.
6,464,332 B1 * 10/2002 Silverbrook et al. ..... 347/42
6,474,765 B2 * 11/2002 Beauchamp ..... 347/14
6,663,206 B2 * 12/2003 Taylor ..... 347/9
6,775,022 B2 * 8/2004 Noyes et al. ..... 358/1.15
2002/0008731 A1 * 1/2002 Matsumoto et al. ..... 347/42
2003/0142161 A1 * 7/2003 Miura et al. ..... 347/19
2004/0021715 A1 * 2/2004 Serra et al. ..... 347/12

FOREIGN PATENT DOCUMENTS

EP 0 914 950 A2 5/1999
EP 0 968 832 A1 1/2000
JP 62-5771 A 1/1987
JP 3-281264 A 12/1991
JP 5-57965 A 3/1993
JP 2001-1510 A 1/2001

* cited by examiner

*Primary Examiner*—Manish S. Shah
*Assistant Examiner*—Laura E. Martin
(74) *Attorney, Agent, or Firm*—Frishauf, Holtz, Goodman & Chick, P.C.

(57) ABSTRACT

An image forming apparatus includes a recording head unit in which a plurality of recording heads are arranged in substantially the same direction as the arranging direction of recording elements such that an overlapped region is formed between the heads, a set angle/overlapped region detector which detects the width of the overlapped region of each of the plurality of recording heads from a predetermined test chart printed using the recording head unit, and an image data distributor which distributes image data input to each of the plurality of recording heads, in accordance with the detected width of the overlapped region between the heads. This apparatus achieves an effect of eliminating density unevenness in the head overlapped region only by rough head alignment.

8 Claims, 5 Drawing Sheets

IMAGE FORMING APPARATUS

CROSS-REFERENCE TO RELATED APPLICATIONS

This is a Continuation Application of PCT Application No. PCT/JP02/00890, filed Feb. 4, 2002, which was not published under PCT Article 21 (2) in English.

This application is based upon and claims the benefit of priority from the prior Japanese Patent Application No. 2001-029835, filed Feb. 6, 2001, the entire contents of which are incorporated herein by reference.

BACKGROUND OF THE INVENTION

1. Field of the Invention

The present invention relates to an image forming apparatus.

2. Description of the Related Art

A high-speed image forming apparatus capable of simultaneously forming images of a plurality of lines by one-time scan by arranging a plurality of recording heads in substantially the same direction as a nozzle arranging direction such that overlapped regions are formed between the heads is conventionally known. In addition, various methods of improving image forming apparatuses of this type have been proposed. For example, Jpn. Pat. Appln. KOKAI Publication No. 5-57965 discloses an image forming apparatus which eliminates density unevenness in the head overlapped regions.

Unfortunately, the conventional techniques including Jpn. Pat. Appln. KOKAI Publication No. 5-57965 described above have the problem that highly accurate head alignment is necessary.

BRIEF SUMMARY OF THE INVENTION

It is an object of the present invention to provide an image forming apparatus capable of eliminating density unevenness in the head overlapped regions only by rough head alignment.

An image forming apparatus according to the first invention comprises a recording head unit in which a plurality of recording heads are arranged in substantially the same direction as the arranging direction of recording elements such that an overlapped region is formed between the heads, a detector which detects a width of the overlapped region of each of the plurality of recording heads from a predetermined test chart printed using the recording head unit, and an image data distributor which distributes image data input to each of the a plurality of recording heads, in accordance with the detected width of the overlapped region between the heads.

An image forming apparatus according to the second invention comprises a recording head unit in which a plurality of recording heads are arranged in substantially the same direction as the arranging direction of recording elements such that an overlapped region is formed between the heads, a detector which detects a set angle of each of the plurality of recording heads from a predetermined test chart printed using the recording head unit, and a driving timing correction unit which, when driving the recording elements of each of the plurality of recording heads, corrects the driving timing of each recording element in accordance with the detected set angle.

An image forming apparatus according to the third invention comprises a recording head unit in which a plurality of recording heads are arranged in substantially the same direction as the arranging direction of recording elements such that an overlapped region is formed between the heads, a detector which detects a set angle and a width of the overlapped region of each of the plurality of recording heads from a predetermined test chart printed using the recording head unit, an image data distributor which distributes image data input to each of the plurality of recording heads, in accordance with the detected width of the overlapped region between the heads, and a driving timing correction unit which, when driving the recording elements of each of the plurality of recording heads in accordance with the distributed image data, corrects the driving timing of each recording element in accordance with the detected set angle.

DETAILED DESCRIPTION OF THE INVENTION

Figure 1:
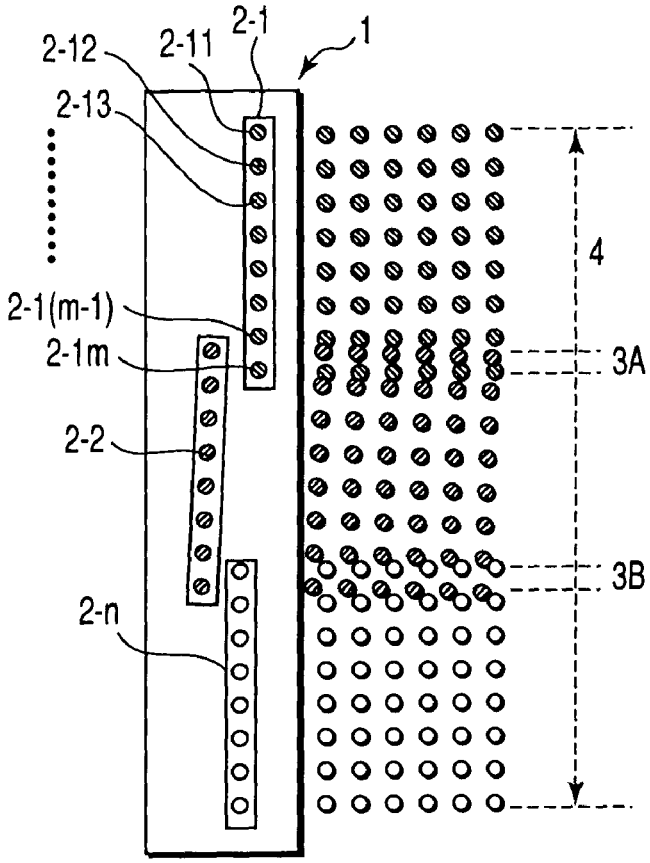
FIG. 1 is a view showing an outline of a recording head unit including a plurality of recording heads to which the present invention is applied.

An embodiment of the present invention will be described in detail below with reference to the accompanying drawing. FIG. 1 is a view showing an outline of a recording head unit including a plurality of recording heads of an inkjet printer to which the present invention is applied. As shown in FIG. 1, a plurality of recording heads 2-1, 2-2, . . . , 2-n are arranged on a base 1 in substantially the same direction as the arranging direction of nozzles (recording elements; 2-11, 2-12, . . . , 2-1(m−1), and 2-1m for the recording head 2-1) for discharging printing ink so as to have predetermined overlapped regions 3A and 3B between the heads, thereby forming one recording head unit. Reference numeral 4 denotes a recording width. A recording head unit having this arrangement records one page on a recording medium by performing scan at least once.

Figure 2:
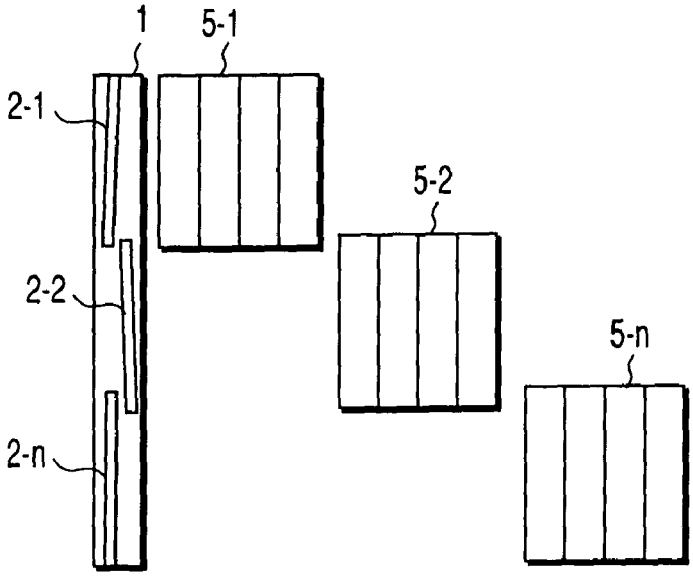
FIG. 2 is a view for explaining printing of test charts used in this embodiment.

FIG. 2 is a view for explaining printing of test charts used in this embodiment. In this embodiment, test charts 5-1, 5-2, and 5-n are formed by performing printing four times by using the recording heads 2-1, 2-2, . . . , 2-n, respectively. By reading and analyzing the test charts 5-1, 5-2, and 5-n, the set angles of the recording heads 2-1, 2-2, . . . , 2-n and the widths of the overlapped regions 3A and 3B can be detected. The detected set angles and overlapped region widths are stored as correction data. When printing is actually performed using the recording heads 2-1, 2-2, . . . , 2-n, the discharge timings of the nozzles of the recording heads 2-1, 2-2, . . . , 2-n are corrected in accordance with the set angle data, and input image data to the recording heads 2-1, 2-2, . . . , 2-n is distributed in accordance with the overlapped region widths.

Figure 3:
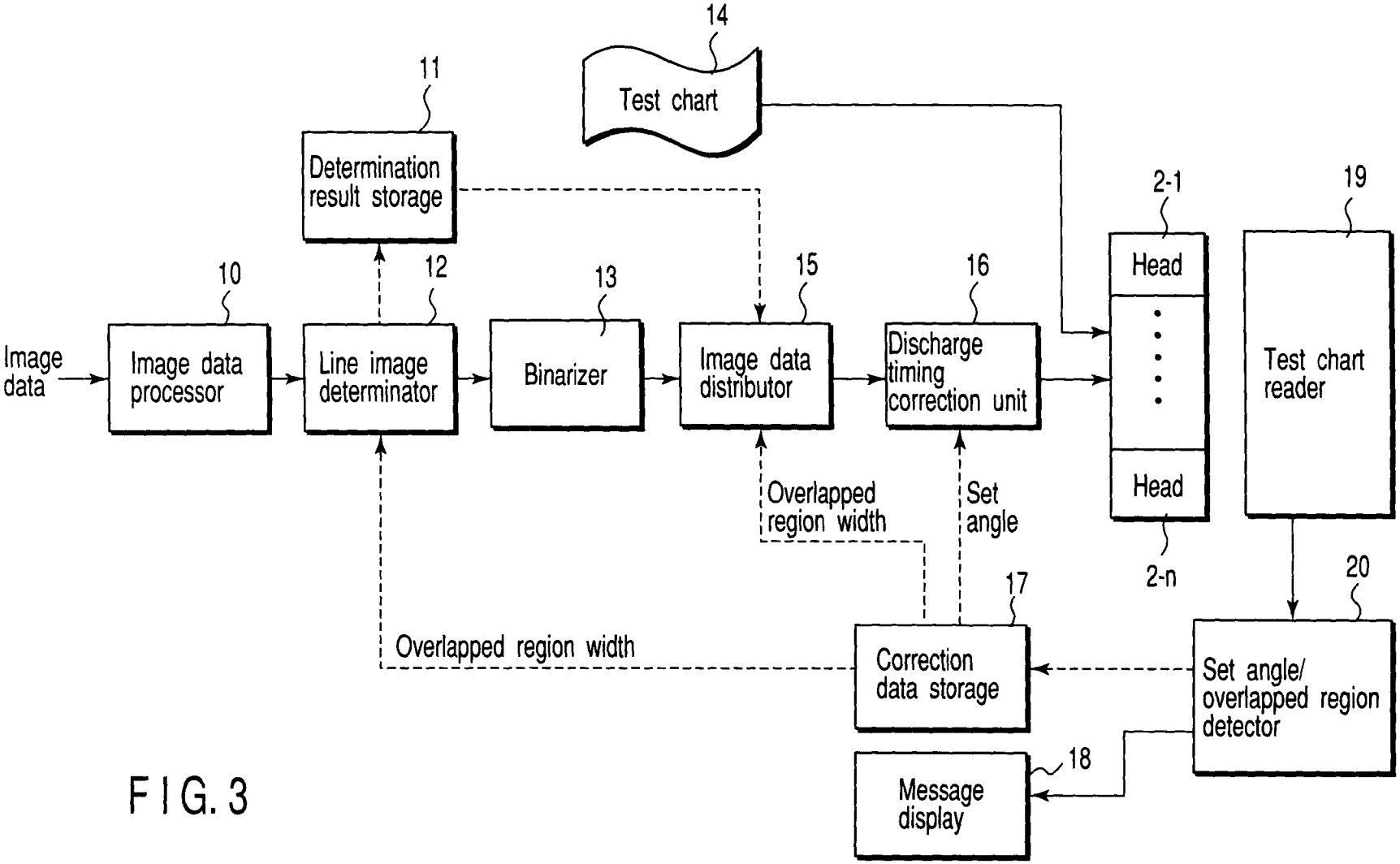
FIG. 3 is a block diagram showing the arrangement of an image forming apparatus according to this embodiment.

FIG. 3 is a block diagram showing the arrangement of an image forming apparatus according to this embodiment. Prior to an actual printing process, test charts as explained with reference to FIG. 2 are formed by driving the recording heads 2-1, 2-2, . . . , 2-n on the basis of test chart data 14. The formed test charts are read by a test chart reader 19 such as a scanner, and the set angles and overlapped region widths of the recording heads 2-1, 2-2, . . . , 2-n are detected by a set angle/overlapped region detector 20. The detected set angles and overlapped region widths are stored as correction data in a correction data storage 17.

A message display (notification unit) 18 displays a message which demands head replacement or adjustment if the detected set angle or overlapped region width exceeds an allowable range. If even one of the recording heads 2-1, 2-2, . . . , 2-n is replaced or adjusted, a new test chart is printed, and the set angles and overlapped region widths of the recording heads 2-1, 2-2, . . . , 2-n are detected again by using the printed test chart.

In an actual printing process, an image data processor 10 performs image processing, e.g., converts input RGB image data into CMYK image data. A line image determinator 12 determines, for each overlapped region width, whether image data in the overlapped region is a line image by using the overlapped region width data stored in the correction data storage 17. The determination result is stored in a determination result storage 11. Image data subjected to the determination by the line image determinator 12 is binarized by a binarizer 13, and input to an image data distributor 15. The image data distributor 15 distributes the input image data on the basis of the line image information stored in the determination result storage 11 and the overlapped region width data stored in the correction data storage 17. This image data distribution process will be described later.

The image data thus distributed on the basis of the overlapped regions is supplied to a discharge timing correction unit (driving timing correction unit) 16. The discharge timing correction unit 16 corrects the discharge timings of the nozzles of the recording heads 2-1, 2-2, . . . , 2-n on the basis of the set angle data stored in the correction data storage 17. The recording heads 2-1, 2-2, . . . , 2-n print an image by discharging ink from the nozzles at the corrected discharge timings in accordance with the input image data.

Figure 4:
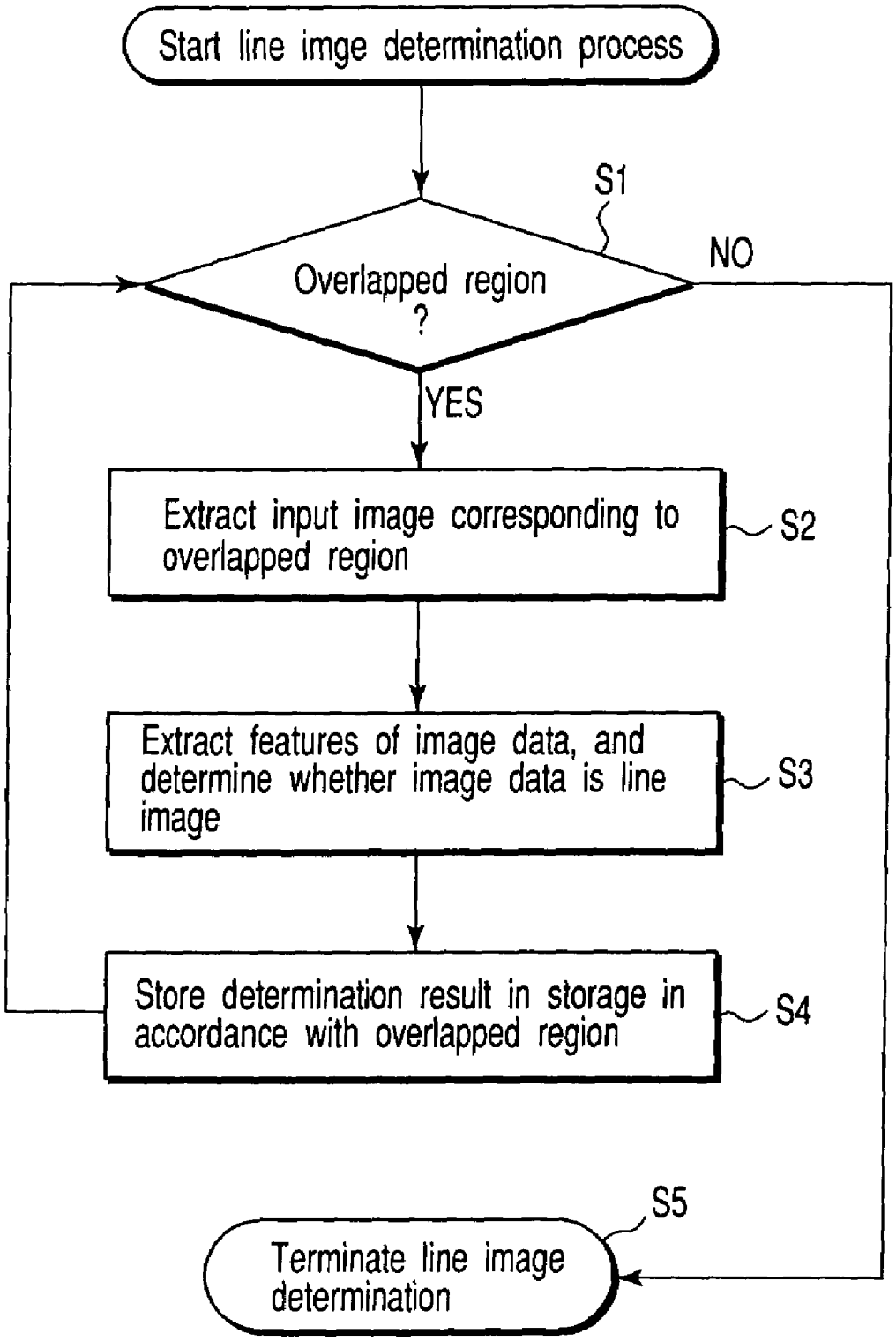
FIG. 4 is a flow chart of a line image determination process performed by a line image determinator 12.

FIG. 4 is a flow chart of the line image determination process in the line image determinator 12. First, the line image determinator 12 determines whether input image data has an overlapped region (step S1). If NO in step S1, the line image determinator 12 terminates the line image determination process by doing nothing (step S5). If YES in step S1, the line image determinator 12 extracts an input image corresponding to the overlapped region (step S2). Then, the line image determinator 12 extracts features of the extracted image data and determines whether the image data is a line image in accordance with a known method (step S3). The result of the determination of whether the image data is a line image is stored in the determination result storage 11 in accordance with the overlapped region (step S4). The flow then returns to step S1 to determine whether there is another overlapped region. If there is another overlapped region, the line image determinator 12 performs the processing from step S2. If there is no more overlapped region, the line image determinator 12 completes the line image determination process.

Figure 5C:
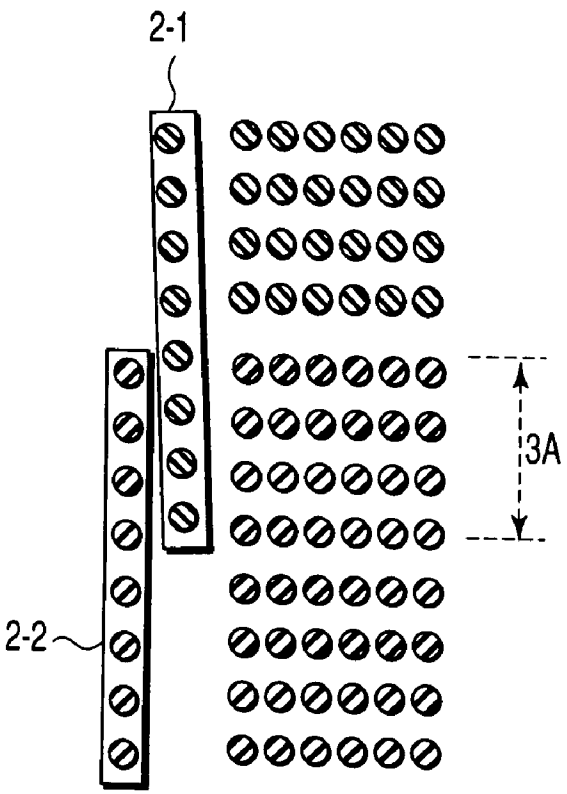
FIGS. 5A to 5C are views for explaining an image distribution process performed by an image data distributor 15.
Figure 5B:
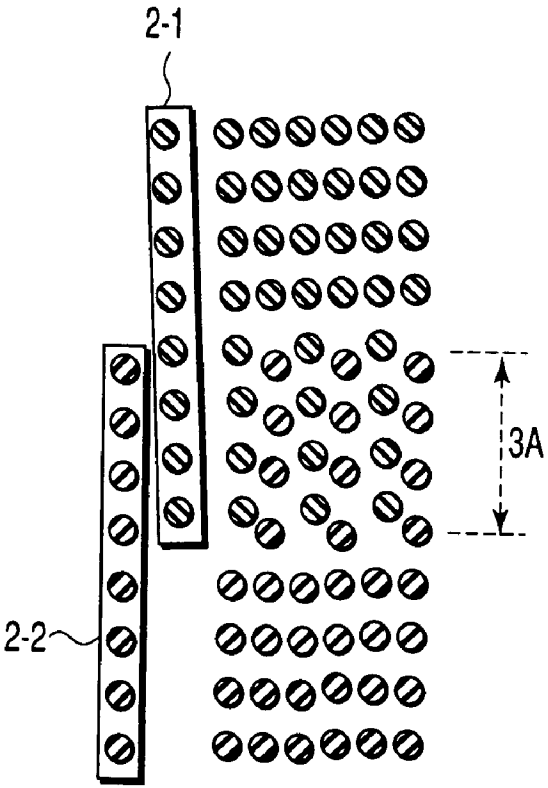
Figure 5A:
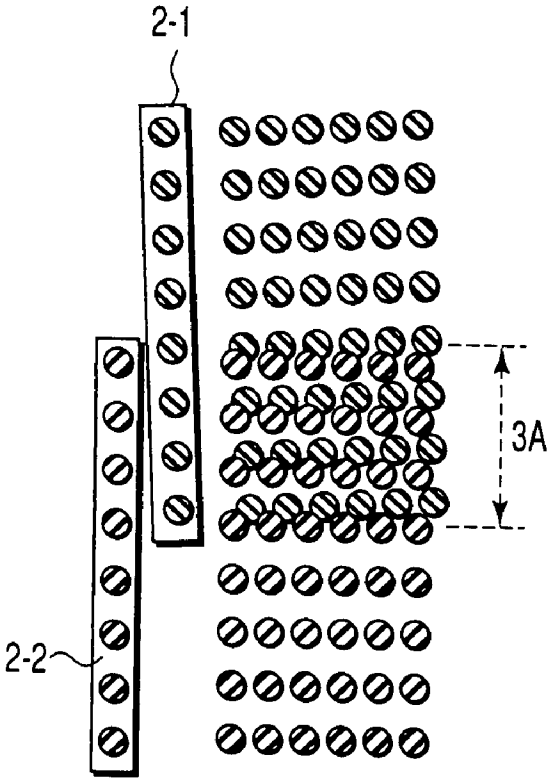

FIGS. 5A to 5C are views for explaining the image distribution process in the image data distributor 15. As shown in FIG. 5A, if printing is directly performed by using the recording heads 2-1 and 2-2 having some overlapped nozzles, printed images are overlapped in the overlapped region 3A by ink discharged from the overlapped nozzles. To avoid this overlapped printing, as shown in FIG. 5B, image data is so distributed that complementary printing is performed in the overlapped region 3A by alternately driving the recording heads 2-1 and 2-2. When image data is a natural image, the overlapped region 3A is beautifully printed. However, if image data is found to be a line image, the image printed by complementary printing cannot be linear (the image is zigzagged), so no clear line image can be printed (FIG. 5B).

If image data is a line image in the overlapped region 3A, therefore, this image data is so distributed that the nozzles of only one of the recording heads 2-1 and 2-2 are driven, thereby performing no complementary printing. FIG. 5C shows an example of an image printed by driving only the recording head 2-2 in the overlapped region 3A. In this way, a clear line image can be printed in the overlapped region 3A.

Figure 6:
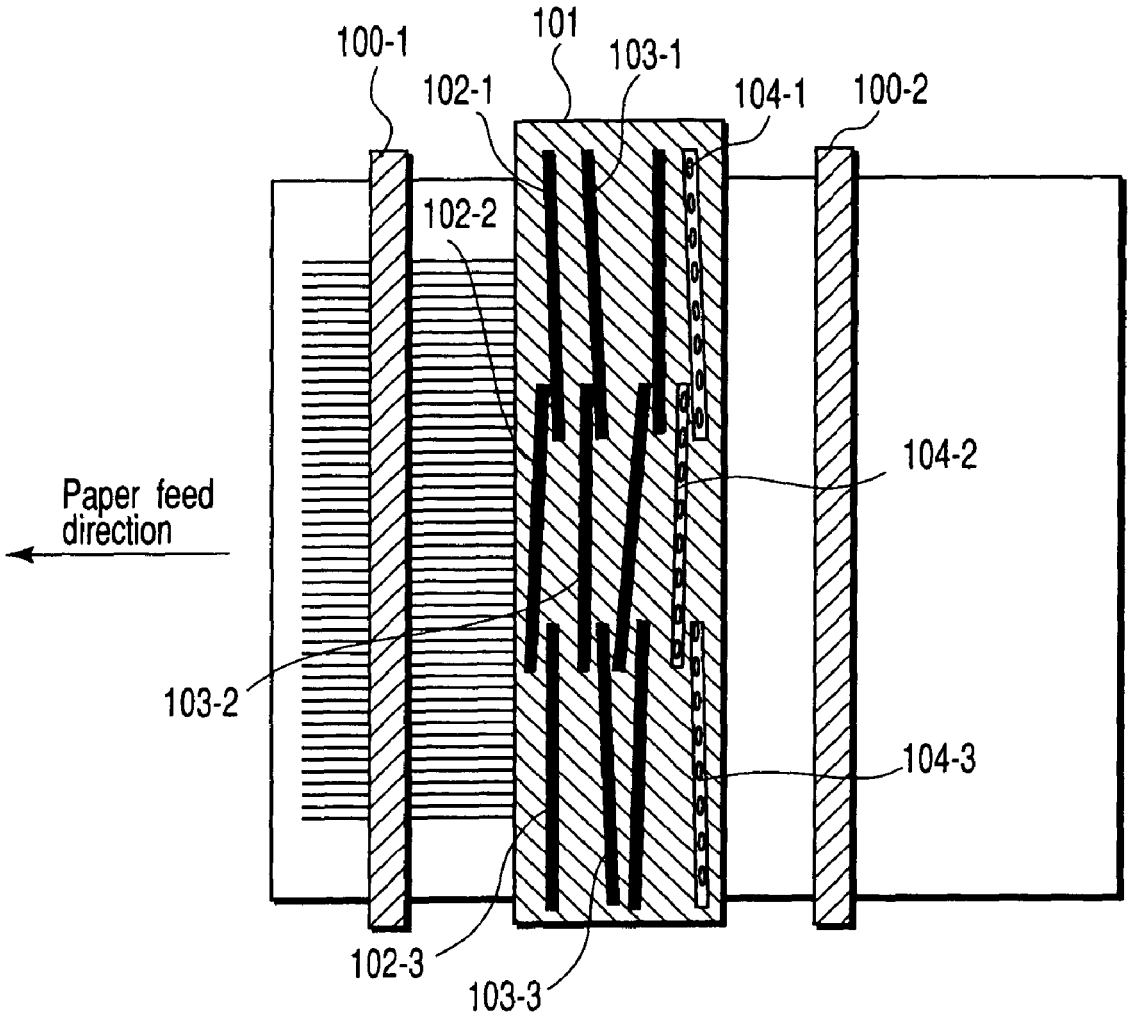
FIG. 6 is a view showing an example in which the image forming apparatus of this embodiment is applied to a high-speed recording apparatus capable of color printing.

FIG. 6 is a view showing an example in which the image forming apparatus of this embodiment is applied to a high-speed recording apparatus capable of color printing. Reference numerals 100-1 and 100-2 denote paper feed rollers; and 101, a head fixing device in which recording heads 102-1, 102-2, and 102-3 for cyan (C), recording heads 103-1, 103-2, and 103-3 for magenta (M), recording heads for yellow (Y), and recording heads 104-1, 104-2, and 104-3 for black (K) are so arranged as to have overlapped regions between the heads.

In the above embodiment, the set angles and the widths of overlapped regions of a plurality of recording heads are detected from test patterns printed in advance. In actual printing, input image data is distributed on the basis of the detected overlapped region widths, and the discharge timings of nozzles are corrected on the basis of the detected set angles. Therefore, density unevenness in the head overlapped regions can be eliminated only by rough head alignment.

As has been described in detail above, the present invention comprises a recording head unit in which a plurality of recording heads are arranged in substantially the same direction as the arranging direction of recording elements such that an overlapped region is formed between the heads, a detector which prints a predetermined test chart by using the recording head unit, and detects the width of the overlapped region of each of the plurality of recording heads from the printed test chart, and an image data distributor which distributes image data input to each of the plurality of recording heads, in accordance with the detected width of the overlapped region between the heads.

Also, the present invention comprises a recording head unit in which a plurality of recording heads are arranged in substantially the same direction as the arranging direction of recording elements such that an overlapped region is formed between the heads, a detector which prints a predetermined test chart by using the recording head unit, and detects the set angle of each of the plurality of recording heads from the printed test chart, and a driving timing correction unit which, when driving the recording elements of each of the plurality of recording heads, corrects the driving timing of each recording element in accordance with the detected set angle.

Furthermore, the present invention comprises a recording head unit in which a plurality of recording heads are arranged in substantially the same direction as the arranging direction of recording elements such that an overlapped region is formed between the heads, a detector which prints a predetermined test chart by using the recording head unit, and detects the set angle and the width of the overlapped region of each of the plurality of recording heads from the printed test chart, an image data distributor which distributes image data input to each of the plurality of recording heads, in accordance with the detected width of the overlapped region between the heads, and a driving timing correction unit which, when driving the recording elements of each of the plurality of recording heads in accordance with the distributed image data, corrects the driving timing of each recording element in accordance with the detected set angle.

With the above arrangements, an image forming apparatus capable of eliminating density unevenness in the head overlapped regions only by rough head alignment can be provided.

What is claimed is:

1. An image forming apparatus comprising:

a recording head unit in which a plurality of recording heads are arranged in substantially the same direction as an arranging direction of recording elements such that an overlapped region is formed between the heads;

a detector which detects a width of the overlapped region of each of said plurality of recording heads from a predetermined test chart printed using the recording head unit;

a line image determinator which determines whether or not image data corresponding to the overlapped region between the heads is a line image; and an image data distributor which distributes image data input to each of said plurality of recording heads, in accordance with the detected width of the overlapped region between the heads;

wherein if the image data corresponding to the overlapped region between the heads is found to be a line image by the image data determinator, the image data distributor distributes the image data so that no complementary printing is performed in the overlapped region.

2. An image forming apparatus comprising:

a recording head unit in which a plurality of recording heads are arranged in substantially the same direction as an arranging direction of recording elements such that an overlapped region is formed between the heads;

a detector which detects a set angle and a width of the overlapped region of each of said plurality of recording heads from a predetermined test chart printed using the recording head unit;

a line image determinator which determines whether or not image data corresponding to the overlapped region between the heads is a line image;

an image data distributor which distributes image data input to each of said plurality of recording heads, in accordance with the detected width of the overlapped region between the heads; and a driving timing correction unit which, when driving the recording elements of each of said plurality of recording heads in accordance with the distributed image data, corrects a driving timing of each recording element in accordance with the detected set angle;

wherein if the image data corresponding to the overlapped region between the heads is found to be a line image by the image data determinator, the image data distributor distributes the image data so that no complementary printing is performed in the overlapped region.

3. An image forming apparatus according to claim 1, further comprising a notification unit which, if the detected width of the overlapped region of one of said plurality of recording heads exceeds a predetermined allowable range, notifies a message demanding replacement or adjustment of the recording head.

4. An image forming apparatus according to claim 2, further comprising a notification unit which, if at least one of the detected set angle and the detected width of the overlapped region of one of said plurality of recording heads exceeds a predetermined allowable range, notifies a message demanding replacement or adjustment of the recording head.

5. An image forming apparatus according to claim 1, wherein if at least one of said plurality of recording heads is replaced or adjusted, a predetermined test chart is printed, and the width of the overlapped region of each of said plurality of recording heads is detected again from the printed test chart.

6. An image forming apparatus according to claim 2, wherein if at least one of said plurality of recording heads is replaced or adjusted, a predetermined test chart is printed, and at least one of the set angle and the width of the overlapped region of each of said plurality of recording heads is detected again from the printed test chart.

7. An image forming apparatus according to claim 1, wherein a plurality of said recording head units are provided in correspondence with different color outputs.

8. An image forming apparatus according to claim 2, wherein a plurality of said recording head units are provided in correspondence with different color outputs.

* * * * *